US009020412B2

(12) United States Patent
Osaki et al.

(10) Patent No.: US 9,020,412 B2
(45) Date of Patent: Apr. 28, 2015

(54) CURL CORRECTING DEVICE AND IMAGE FORMING APPARATUS WITH SAME

(71) Applicant: KYOCERA Document Solutions Inc., Osaka-shi, Osaka (JP)

(72) Inventors: Shuji Osaki, Osaka (JP); Tsuyoshi Koyanagi, Osaka (JP); Yuta Okuno, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 14/226,205

(22) Filed: Mar. 26, 2014

(65) Prior Publication Data

US 2014/0294478 A1 Oct. 2, 2014

(30) Foreign Application Priority Data

Mar. 28, 2013 (JP) ..... 2013-070182

(51) Int. Cl.

*G03G 15/00* (2006.01)
*G03G 21/00* (2006.01)
*B65H 29/12* (2006.01)

(52) U.S. Cl.

CPC .. *G03G 15/6576* (2013.01); *G03G 2215/00662* (2013.01); *B65H 2301/51256* (2013.01); *B65H 29/125* (2013.01); *B65H 2404/1421* (2013.01); *B65H 2404/143* (2013.01); *B65H 2511/17* (2013.01); *B65H 2511/212* (2013.01); *B65H 2511/22* (2013.01)

(58) Field of Classification Search

CPC ..... G03G 15/6576; G03G 2215/00662; G03G 15/00704; B41J 11/0005; B65H 2301/5121; B65H 29/70; B65H 2301/51256
USPC ..... 399/406
See application file for complete search history.

(56) References Cited

U.S. PATENT DOCUMENTS 8,588,674 B2 * 11/2013 Nanayama ..... 399/406
8,862,047 B2 * 10/2014 Furushige et al. ..... 399/406

FOREIGN PATENT DOCUMENTS

JP 2009-29554 2/2009

* cited by examiner

*Primary Examiner* — Matthew G Marini
*Assistant Examiner* — Justin Olamit
(74) *Attorney, Agent, or Firm* — Gerald E. Hespos; Michael J. Porco; Matthew T. Hespos

(57) ABSTRACT

A curl correcting device includes a first roller, a second roller and a supporting unit. The supporting unit includes a first conveyance path and a second conveyance path. The first roller is rotated about a first rotary shaft and elastically deformable. The second roller is rotated about a second rotary shaft and elastically deforms the first roller by being pressed against the first roller, thereby forming a curved nip portion between the first and second rollers. The supporting unit is rotatable about a third rotary shaft and rotatably supports the first and second rollers. The first conveyance path communicates with the sheet conveyance path by the supporting unit being arranged at a first position about the third rotary shaft. The second conveyance path communicates with the sheet conveyance path by the supporting unit being arranged at a second position about the third rotary shaft.

15 Claims, 9 Drawing Sheets

CURL CORRECTING DEVICE AND IMAGE FORMING APPARATUS WITH SAME

This application is based on Japanese Patent Application No. 2013-070182 filed with the Japan Patent Office on Mar. 28, 2013, the contents of which are hereby incorporated by reference.

BACKGROUND

The present disclosure relates to a curl correcting device for correcting a curl of a sheet and an image forming apparatus with the same.

Conventionally, a technology is known which can vertically invert a curl correcting device for correcting a curl of a sheet to deal with both an upward curl formed by an upwardly warped leading end part of a sheet and a downward curl formed by a downwardly warped leading end part of a sheet.

In the above curl correcting device, a curl of a sheet is corrected in a nip portion between a hard roller and an elastic roller. The hard roller and the elastic roller are supported in a rotatable rotation unit. In this case, there has been a problem that if a sheet, which is not curled, is carried into the nip portion, the sheet is rather curled.

The present disclosure was made to solve the above problem and aims to provide a curl correcting device which inhibits a sheet, which is not curled, from being curled when the sheet is carried in, and an image forming apparatus with the same.

SUMMARY

A curl correcting device according to one aspect of the present disclosure is arranged to an apparatus main body which includes a sheet conveyance path through which a sheet is conveyed. The curl correcting device includes a first roller, a second roller, a supporting unit. The first roller includes a first rotary shaft and is rotated about the first rotary shaft and has elastically deformable property. The second roller includes a second rotary shaft parallel to the first rotary shaft, is rotated about the second rotary shaft and elastically deforms the first roller by being pressed against the first roller, thereby forming a curved nip portion between the first and second rollers. The supporting unit supports the first and second rollers rotatably about axes by rotatably supporting the first and second rotary shafts, includes a third rotary shaft arranged parallel to the first rotary shaft, and is supported in the casing rotatably about the third rotary shaft. The supporting unit includes a plurality of inner conveyance path inside configured to be a part of the sheet conveyance path. The plurality of inner conveyance path includes a first conveyance path which has the nip portion and a second conveyance path which does not have the nip portion. The second conveyance path intersects with the first conveyance path. The first conveyance path communicates with the sheet conveyance path by the supporting unit being arranged at a first position about the third rotary shaft. The second conveyance path communicates with the sheet conveyance path by the supporting unit being arranged at a second position about the third rotary shaft.

Further, an image forming apparatus according to another aspect of the present disclosure includes the above curl correcting device, an apparatus main body and an image forming section. The image forming section forms an image on a sheet.

These and other objects, features and advantages of the present disclosure will become more apparent upon reading the following detailed description along with the accompanying drawings.

DETAILED DESCRIPTION

Figure 1:
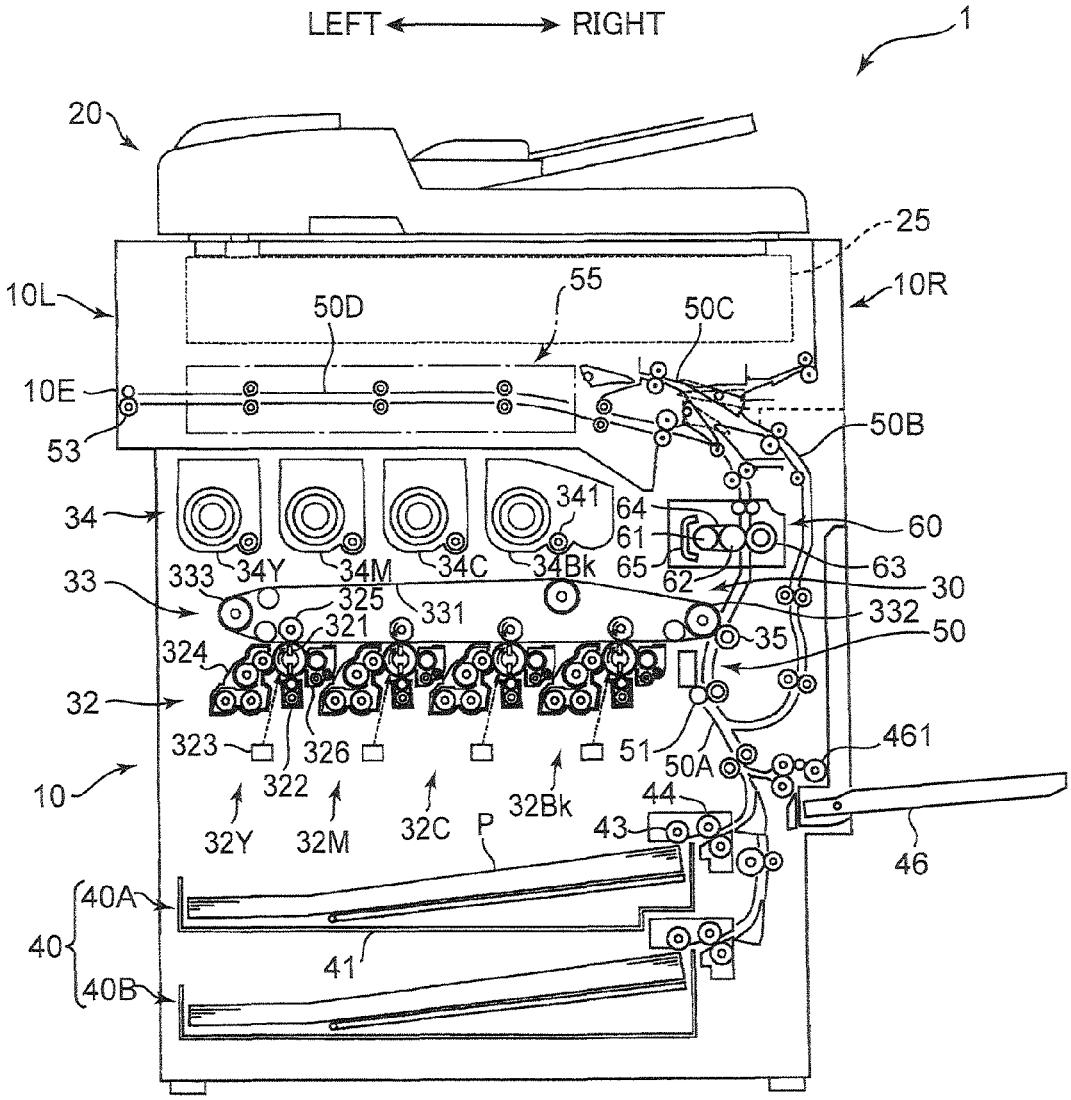
FIG. 1 is a sectional view showing an internal structure of an image forming apparatus according to one embodiment of the present disclosure.

Hereinafter, embodiments of the present disclosure are described in detail based on the drawings. FIG. 1 is a sectional view showing an internal structure of an image forming apparatus 1 according to one embodiment of the present disclosure. Although a complex machine provided with a printer function and a copier function is illustrated as the image forming apparatus 1 here, the image forming apparatus may be a printer, a copier or a facsimile machine.

<Description of Image Forming Apparatus>

The image forming apparatus 1 includes an apparatus main body 10 having a substantially rectangular parallelepipedic housing structure and an automatic document feeder 20 arranged above the apparatus main body 10. A reading unit 25 for optically reading a document image to be copied, an image forming section 30 for forming a toner image on a sheet, a fixing unit 60 for fixing the toner image to the sheet, a sheet feeding unit 40 for storing fixed form sheets to be conveyed to the image forming section 30, a conveyance path 50 for conveying a fixed form sheet from the sheet feeding unit 40 or a manual sheet feeding unit 46 to a sheet discharge opening 10E by way of the image forming section 30 and the fixing unit 60, and a conveying unit 55 (intermediate conveying unit) including a sheet conveyance path constituting a part of the conveyance path 50 inside are housed in the apparatus main body 10.

The automatic document feeder (ADF) 20 is rotatably mounted on the upper surface of the apparatus main body 10 and automatically feeds a document sheet to be copied toward a predetermined document reading position.

The reading unit 25 optically reads an image of a document automatically fed from the ADF 20 or a manually placed document.

The image forming section 30 performs a process for forming a full-color toner image and transferring the toner image onto a sheet, and includes four image forming units 32Y, 32M, 32C and 32Bk arranged in a tandem manner and configured to form toner images of yellow (Y), magenta (M), cyan (C) and black (Bk), an intermediate transfer unit 33 arranged above and adjacent to the image forming unit 32, and a toner supply unit 34 arranged above the intermediate transfer unit 33.

Each of the image forming units 32Y, 32M, 32C, 32Bk includes a photoconductive drum 321, and a charger 322, an exposure device 323, a developing device 324, a primary transfer roller 325 and a cleaning device 326 arranged around this photoconductive drum 321.

The photoconductive drum 321 is rotated about its shaft and an electrostatic latent image and a toner image are formed on the peripheral surface thereof. The charger 322 uniformly charges the surface of the photoconductive drum 321. The exposure device 323 forms an electrostatic latent image by irradiating the peripheral surface of the photoconductive drum 321 with light based on image data of a document image. The developing device 324 supplies toner to the peripheral surface of the photoconductive drum 321 to develop the electrostatic latent image formed on the photoconductive drum 321. The primary transfer roller 325 primarily transfers the toner image on the photoconductive drum 321 to an intermediate transfer belt 331. The cleaning device 326 includes a cleaning blade and the like and cleans the peripheral surface of the photoconductive drum 321 after the transfer of the toner image.

The intermediate transfer unit 33 includes the intermediate transfer belt 331, a drive roller 332 and a driven roller 333. The intermediate transfer belt 331 is an endless belt mounted on the drive roller 332 and the driven roller 333 and toner images are transferred from a plurality of photoconductive drums 321 to the same position of the outer peripheral surface of the intermediate transfer belt 331 in a superimposing manner (primary transfer). A secondary transfer roller 35 (transfer unit) is arranged to face the peripheral surface of the drive roller 332. A full-color toner image superimposed on the intermediate transfer belt 331 is transferred to a sheet in a secondary transfer nip portion between the drive roller 332 and the secondary transfer roller 35.

The toner supply unit 34 includes a toner container for yellow 34Y, a toner container for magenta 34M, a toner container for cyan 34C and a toner container for black 34Bk and stores toner of each color. The toners of the respective colors are supplied to the developing devices 324 of the image forming units 32Y, 32M, 32C and 32Bk corresponding to the colors through unillustrated supply paths.

The sheet feeding unit 40 includes a first sheet cassette 40A and a second sheet cassette 40B arranged in two levels for storing fixed form sheets P out of sheets to which an image forming process is applied. These sheet cassettes can be pulled out forward from the front side of the apparatus main body 10. The first sheet cassette 40A includes a sheet storage portion 41A for storing a sheet stack formed by stacking the fixed form sheets. The uppermost sheet of the sheet stack in the sheet cassette 40A is fed one by one and carried into an upstream end of the conveyance path 50 by driving a pickup roller 43 and a feed roller 44. Note that the second sheet cassette 40B is configured similarly to the first sheet cassette 40A.

A manual feed tray 46 is arranged on a right surface 10R of the apparatus main body 10. A feed roller 461 is arranged near the manual feed tray 46. A lower end part of the manual feed tray 46 is so attached to the apparatus main body 10 that the manual feed tray 46 is openable and closable relative to the apparatus main body 10.

The conveyance path 50 includes a main conveyance path 50A for conveying a sheet P from the sheet feeding unit 40 to the exit of the fixing unit 60 by way of the image forming section 30, a reversing conveyance path 50B for returning a sheet having one side printed to the image forming section 30 in the case of printing both sides of the sheet, a switchback conveyance path 50C for conveying a sheet from a downstream end of the main conveyance path 50A to an upstream end of the reversing conveyance path 50B, and a horizontal conveyance path 50D (sheet conveyance path) for conveying a sheet in a horizontal direction from the downstream end of the main conveyance path 50A to the sheet discharge opening 10E provided in a left surface 10L of the apparatus main body 10. Most of the horizontal conveyance path 50D is formed by the sheet conveyance path provided in the conveying unit 55.

A registration roller pair 51 is arranged upstream of the secondary nip portion in the main conveyance path 50A. A sheet is temporarily stopped at the registration roller pair 51 in a stopped state for a skew correction. Thereafter, the registration roller pair 51 is driven and rotated by a driver (not shown) at a predetermined timing for image transfer, whereby the sheet is fed to the secondary nip portion.

A discharge roller 53 is arranged at a most downstream end of the conveyance path 50. The discharge roller 53 feeds a sheet to a post-processing apparatus arranged on the left surface 10L of the apparatus main body 10 through the sheet discharge opening 10E. Note that, in an image forming apparatus to which no post-processing apparatus is attached, a sheet discharge tray 10TR (FIG. 2) to be described below is provided below the sheet discharge opening 10E.

The conveying unit 55 is a unit for conveying a sheet carried out from the fixing unit 60 to the sheet discharge opening 10E. In the image forming apparatus 1 of this embodiment, the fixing unit 60 is arranged on the side of the right surface 10R of the apparatus main body 10 and the sheet discharge opening 10E is arranged on the side of the left surface 10L of the apparatus main body 10 facing the right surface 10R. Thus, the conveying unit 55 conveys a sheet in the horizontal direction from the right surface 10R to the left surface 10L of the apparatus main body 10. The conveying unit 55 is mountable into the apparatus main body 10 and constitutes a part of the apparatus main body.

The image forming apparatus 1 further includes the unillustrated post-processing apparatus. As described above, the post-processing apparatus is arranged on the left surface 10L of the apparatus main body 10. The post-processing apparatus receives sheets from the sheet discharge opening 10E and applies a predetermined post-processing to the sheets, and then stacks the sheets. Post-processings applied to the sheets include stapling and bookbinding.

The fixing unit 60 is a fixing device of an induction heating type for applying a fixing process for fixing a toner image to a sheet, and includes a heating roller 61, a fixing roller 62, a pressure roller 63, a fixing belt 64 and an induction heating unit 65. The pressure roller 63 is pressed into contact with the fixing roller 62 to form a fixing nip portion. A sheet passes through the fixing nip portion, whereby a toner image transferred to the sheet is fixed to the sheet.

Figure 2:
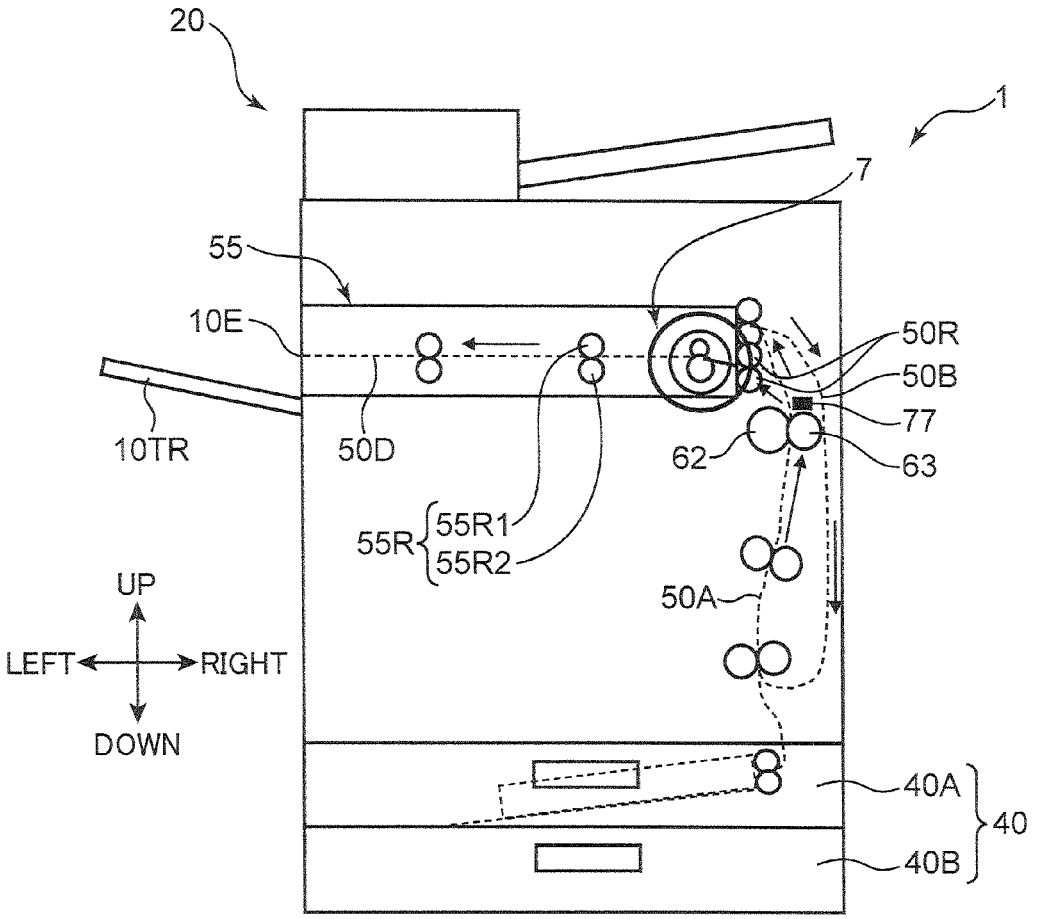
FIG. 2 is a schematic sectional view of the image forming apparatus showing the arrangement of a curl correcting device according to the embodiment of the present disclosure.
Figure 3:
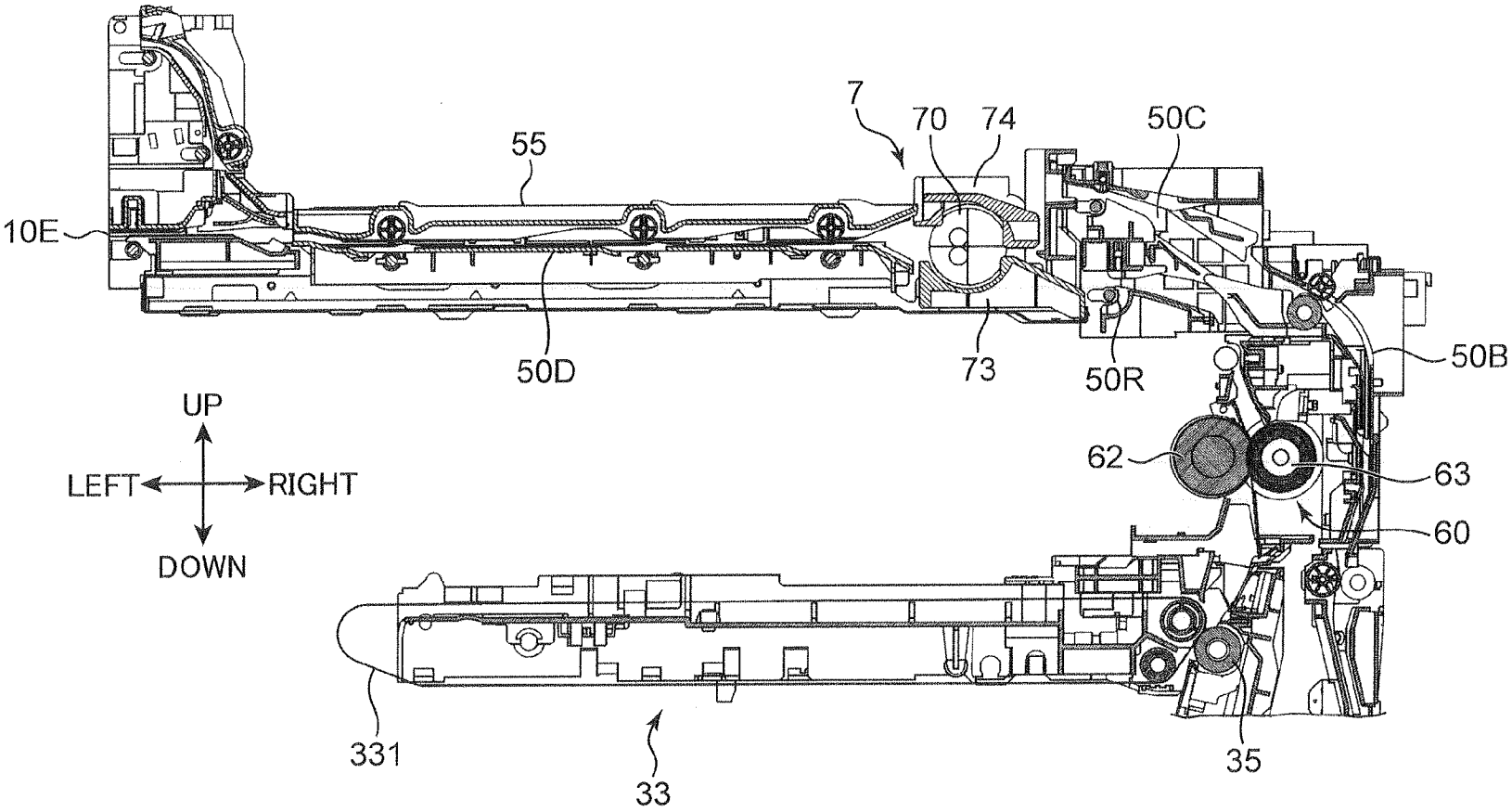
FIG. 3 is a sectional view of a part of the image forming apparatus showing the arrangement of the curl correcting device according to the embodiment of the present disclosure.

Further, the image forming apparatus 1 includes a curl correcting device 7. FIGS. 2 and 3 are schematic sectional views showing the arrangement of the curl correcting device 7 in the image forming apparatus 1. Note that FIG. 3 is a sectional view showing a positional relationship of the intermediate transfer unit 33, the fixing unit 60, the curl correcting device 7 and the conveying unit 55 in the image forming apparatus 1. The curl correcting device 7 has a function of correcting a curl of a sheet (decurler). The curl correcting device 7 is arranged on an upstream side in a sheet conveying direction in the conveying unit 55. A sheet, to which the fixing process is applied in the fixing unit 60, is conveyed to the conveying unit 55 by a discharge roller pair 50R (discharging unit) arranged downstream of the fixing unit 60. The curl correcting device 7 conveys the sheet to a downstream roller pair 55R arranged in the conveying unit 55 after correcting a curl of the sheet transferred from the discharge roller pair 50R. The downstream roller pair 55R is arranged downstream of the curl correcting device 7 in the sheet conveying direction in the horizontal conveyance path 50D. The downstream roller pair 55R is composed of a first downstream roller 55R1 and a second downstream roller 55R2. The sheet conveyed from the curl correcting device 7 is conveyed toward the sheet discharge opening 10E while being sandwiched between the first and second downstream rollers 55R1, 55R2. Thereafter, the sheet P is discharged to the sheet discharge tray 10TR or the aforementioned post-processing apparatus mounted to the left of the sheet discharge opening 10E.

In the fixing unit 60, the sheet is heated by the fixing roller 62 in applying the fixing process to the sheet. Further, the sheet is pressed against the fixing roller 62 by the pressure roller 63. At this time, the toner image is fixed to a surface of the sheet facing the fixing roller 62. Due to the contraction of the toner image by heat, the sheet may be so curled (curved) that a side facing the fixing roller 62 (first surface) is on an inner peripheral side and a side facing the pressure roller 63 (second surface) is on an outer peripheral side. If the sheet is curled, the storage property of the sheet discharged onto the sheet discharge tray 10TR or the post-processing apparatus is deteriorated. By correcting the curl by the curl correcting device 7, the storage property of the sheet is stably maintained.

Figure 4:
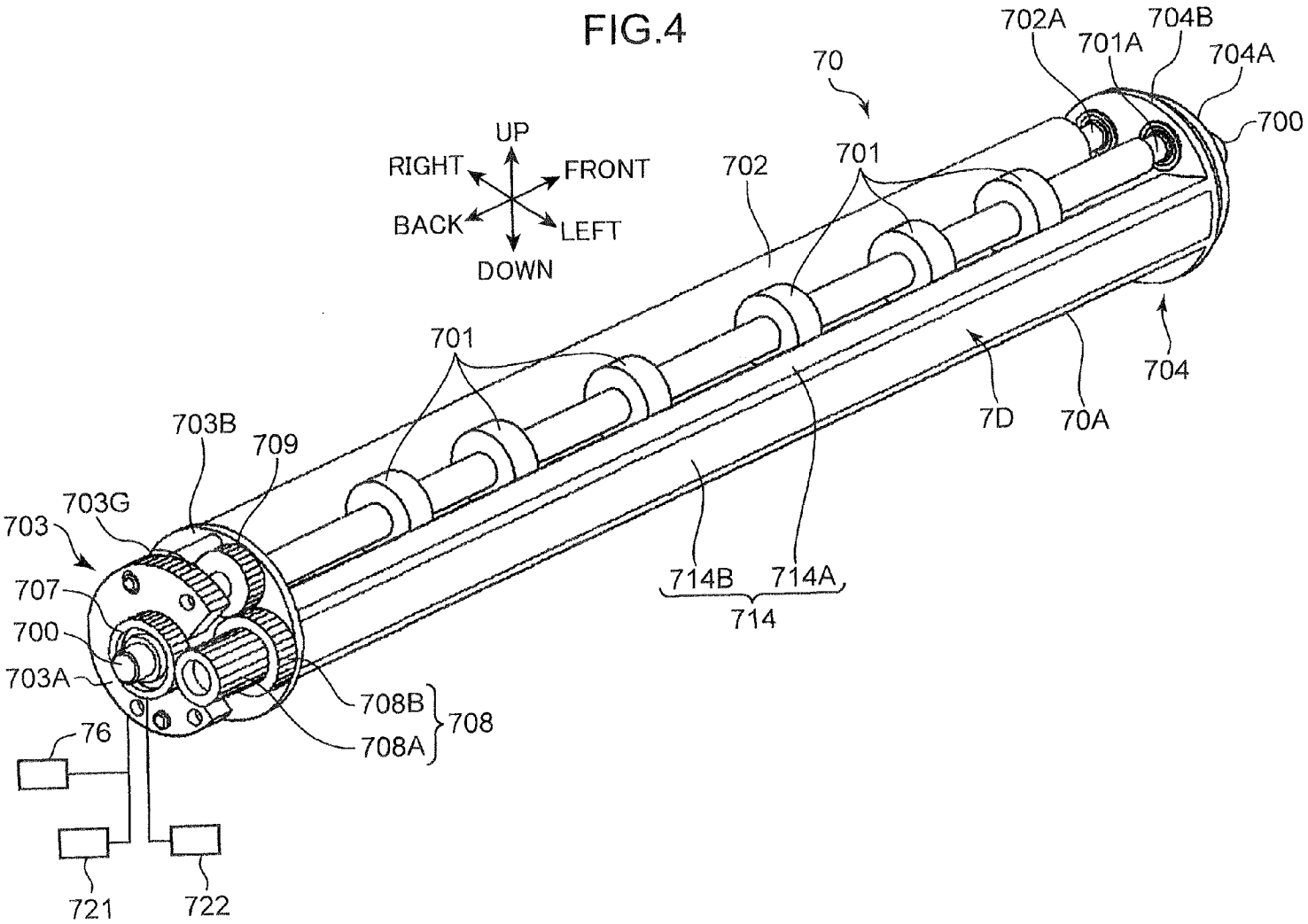
FIG. 4 is a perspective view of a correcting unit according to the embodiment of the present disclosure.
Figure 5:
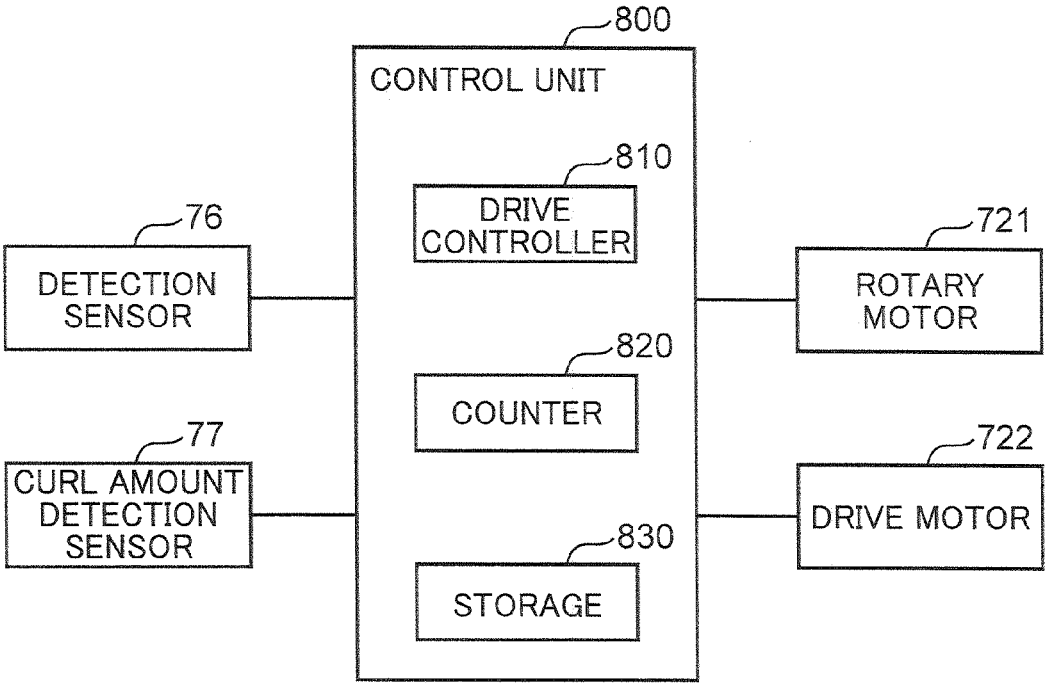
FIG. 5 is an electrical block diagram relating to rotary drive of the correcting unit according to the embodiment of the present disclosure.
Figure 6:
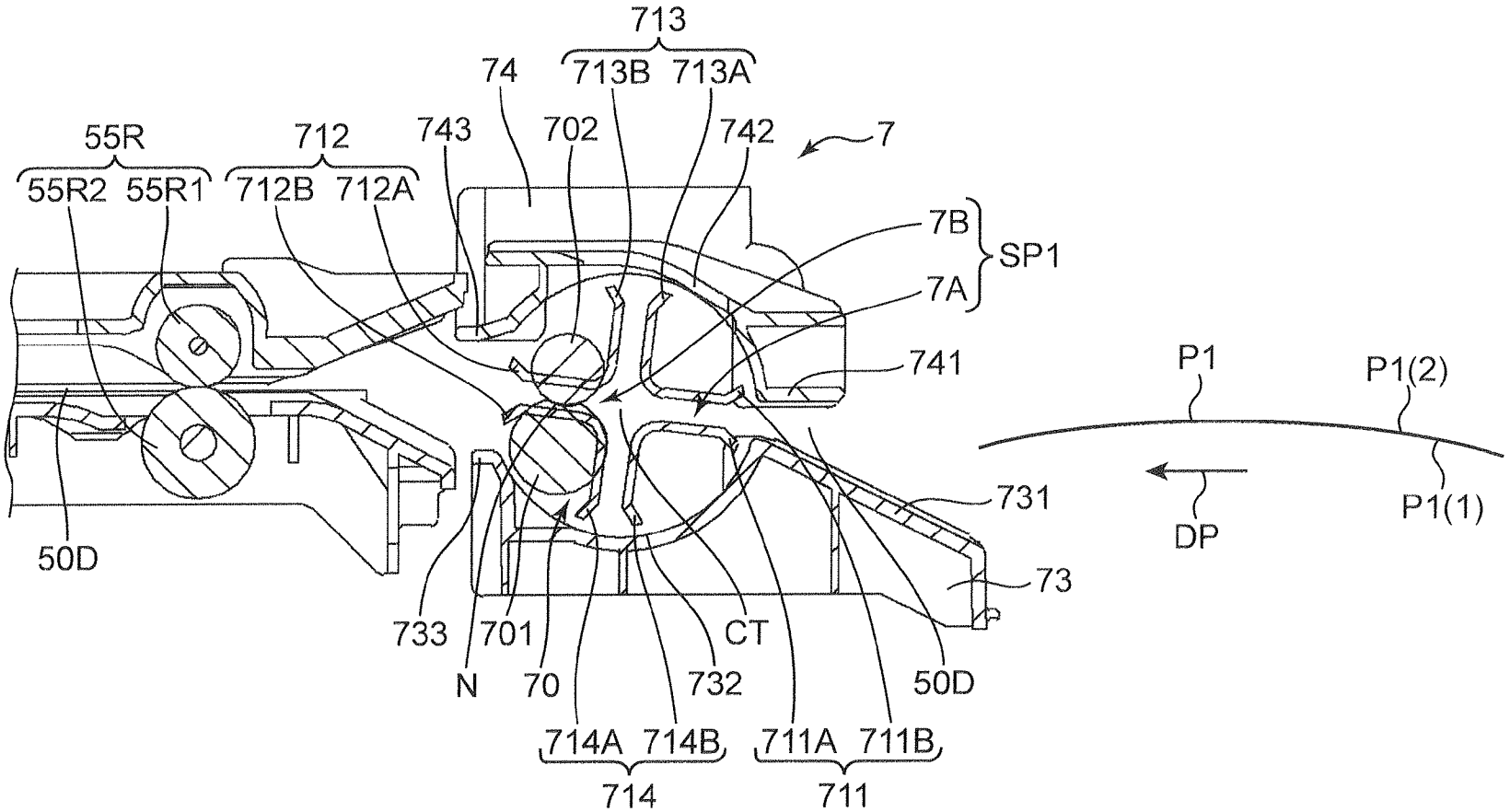
FIG. 6 is a sectional view of the curl correcting device in a state where the correcting unit according to the embodiment of the present disclosure is arranged at a first position.
Figure 7:
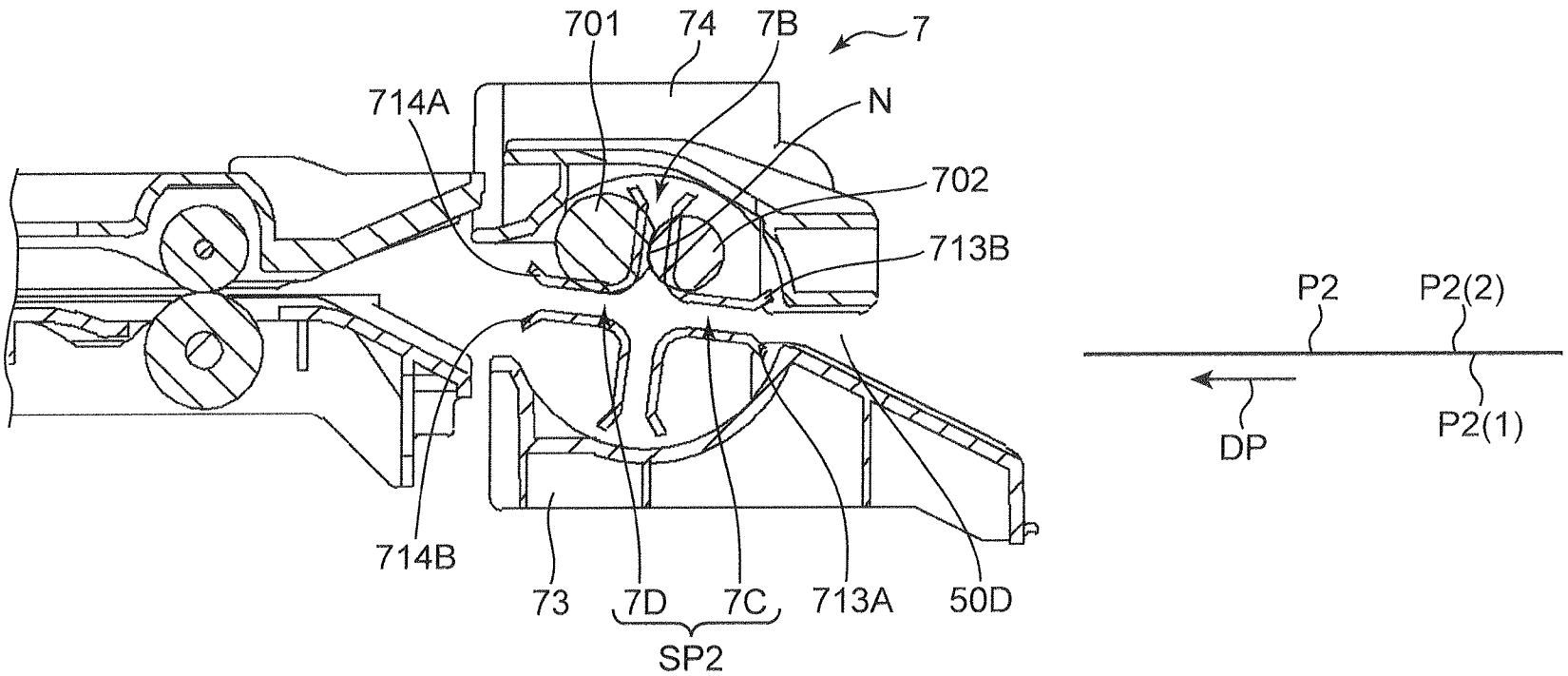
FIG. 7 is a sectional view of the curl correcting device in a state where the correcting unit according to the embodiment of the present disclosure is arranged at a second position.
Figure 8:
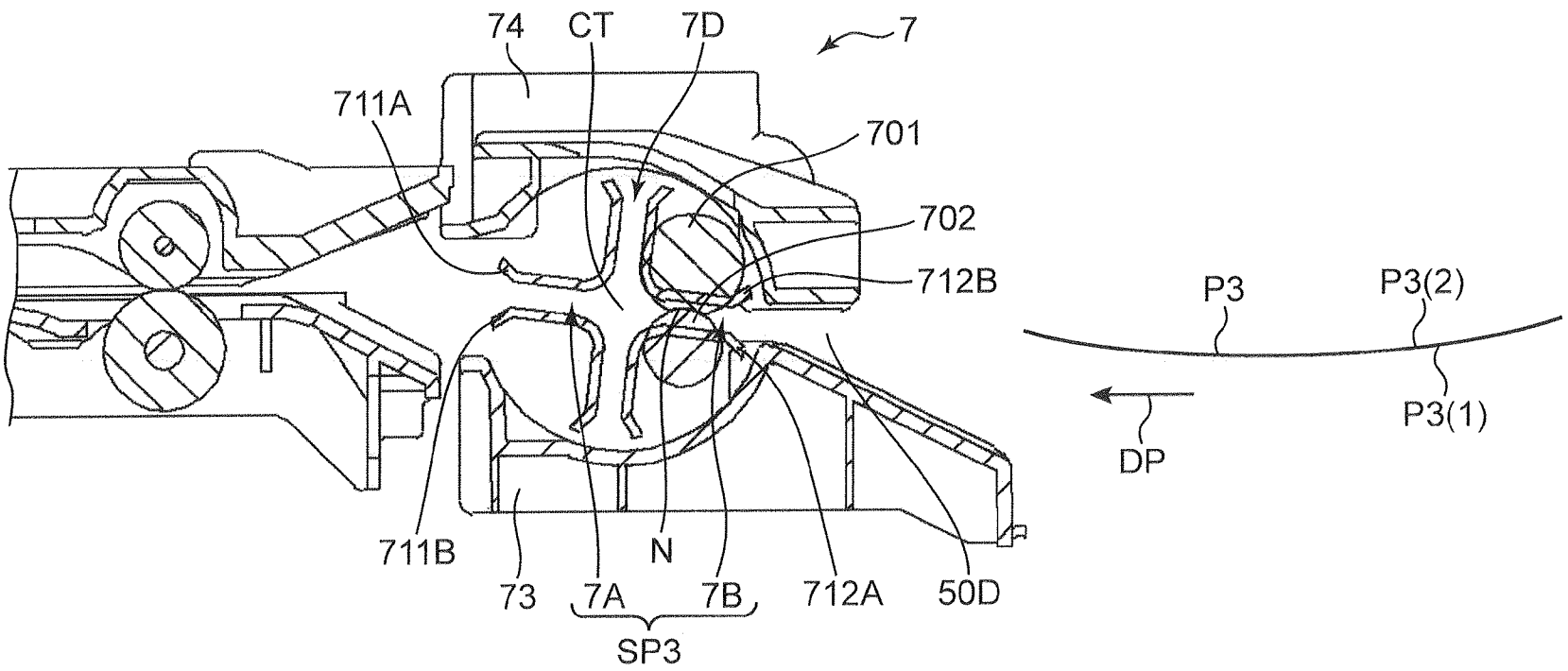
FIG. 8 is a sectional view of the curl correcting device in a state where the correcting unit according to the embodiment of the present disclosure is arranged at a third position.

Next, the curl correcting device 7 according to this embodiment is described in detail with reference to FIGS. 4 to 8. As shown in FIG. 2, the curl correcting device 7 defines a part (sheet conveyance path) of the horizontal conveyance path 50D. In the curl correcting device 7, the horizontal conveyance path 50D is arranged between a lower housing 73 and an upper housing 74 to be described later. The curl correcting device 7 includes a correcting unit 70 (supporting unit), elastic rollers 701 (first roller), a hard roller 702 (second roller), the lower housing 73 and the upper housing 74. FIG. 4 is a perspective view of the correcting unit 70 according to this embodiment. FIG. 5 is an electrical block diagram of a control unit 800 for totally controlling the correcting unit 70. FIG. 6 is a sectional view showing a state where the correcting unit 70 is arranged at a first position in the curl correcting device according to this embodiment. Similarly, FIG. 7 is a sectional view of the curl correcting device 7 in a state where the correcting unit 70 is arranged at a second position and FIG. 8 is a sectional view in a state where the correcting unit 70 is arranged at a third position.

The correcting unit 70 is a main part of the curl correcting device 7. The correcting unit 70 is mounted on an unillustrated frame which is a part of the apparatus main body 10 on front and rear sides of the conveying unit 55. Note that the frame corresponds to parts of the lower housing 73 and the upper housing 74 to be described later. The sheet is conveyed to the left in the horizontal conveyance path 50D to pass through the interior of the correcting unit 70.

The correcting unit 70 includes a plurality of inner conveyance path inside configured to be a part of the sheet conveyance path. The plurality of inner conveyance path includes a first conveyance path SP1 and a third conveyance path SP3 both which have the after-mentioned nip portion N and a second conveyance path SP2 which does not has the nip portion N.

The correcting unit 70 has a substantially cylindrical shape extending in a front-back direction. The correcting unit 70 includes an outer peripheral portion 70A. Further, the correcting unit 70 includes unit shafts 700 (third rotary shaft). The unit shafts 700 serve as a rotary shaft in the rotation of the correcting unit 70. The unit shafts 700 are a pair of shaft portions extending in the front-back direction on opposite side surfaces of the correcting unit 70. A center of rotation CT (see FIG. 6) of the correcting unit 70 is formed between the pair of unit shafts 700. Note that the unit shafts 700 are arranged parallel to an elastic roller shaft 701A and a hard roller shaft 702A to be described later. Further, the correcting unit 70 includes a rear flange portion 703, a front flange portion 704, a first guide portion 711, a second guide portion 712, a third guide portion 713 and a fourth guide portion 714.

The elastic rollers 701 are rotated about the elastic roller shaft 701A (FIG. 4) (first rotary shaft) and has elastically deformable property. The elastic roller shaft 701A serves a rotary shaft in the rotation of the elastic rollers 701. The elastic roller shaft 701A is rotatably supported on the rear and front flange portions 703, 704 to be described later. The elastic rollers 701 are roller members arranged around the elastic roller shaft 701A. A plurality of elastic rollers 701 are arranged at intervals in an axial direction (front-back direction) of the elastic roller shaft 701A. In this embodiment, the elastic rollers 701 are made of a rubber material.

The hard roller 702 is rotated about a hard roller shaft 702A (FIG. 4) (second rotary shaft) parallel to the elastic roller shaft 701A. The hard roller shaft 702A serves a rotary shaft in the rotation of the hard roller 702. The hard roller shaft 702A is rotatably supported on the rear and front flange portions 703, 704 to be described later. The hard roller 702 is a metal roller. In this embodiment, the hard roller 702 is made of a stainless steel material. The hard roller 702 is pressed against the elastic rollers 701 to elastically deform the elastic rollers 701. As a result, a nip portion N through which a sheet is passed is formed between the elastic rollers 701 and the hard roller 702 (see FIG. 6). This nip portion N functions as a curl correcting portion for correcting a curl of a sheet P. By elastically deforming the elastic rollers 701, the nip portion N is curved along the peripheral surface of the hard roller 702.

In other words, the correcting unit 70 supports the elastic rollers 701 and the hard roller 702 rotatably about axes by rotatably supporting the elastic roller shaft 701A and the hard roller shaft 702A. Further, the correcting unit 70 includes the unit shafts 700 arranged parallel to the elastic roller shaft 701A and is supported in the lower housing 73 and the upper housing 74 rotatably about the unit shafts 700.

The rear flange portion 703 is a side wall portion arranged perpendicularly to the unit shaft 700 on a rear side end part of the correcting unit 70. The rear flange portion 703 is composed of two wall portions spaced apart in the front-back direction. Specifically, the rear flange portion 703 includes a first rear flange 703A and a second rear flange 703B. The first rear flange 703A is the wall portion arranged on an axially outer side of the rear flange portion 703. The second rear flange 703B is the wall portion arranged on an axially inner side of the rear flange portion 703. Note that, as shown in FIG. 4, the first rear flange 703A is so shaped that a fan-shaped circumferential part is cut off. The first and second rear flanges 703A, 703B are connected by a plurality of coupling bars (not shown) arranged at intervals in a circumferential direction. Further, an outer peripheral gear portion 703G composed of a plurality of gear teeth is arranged on an outer peripheral part of the first rear flange 703A. The outer peripheral gear portion 703G is coupled to a rotary motor 721 to be described later via an unillustrated transmission gear, whereby a rotational drive force for rotating the correcting unit 70 is transmitted to the outer peripheral gear portion 703G.

The front flange portion 704 is a side wall portion arranged perpendicularly to the unit shaft 700 on a front side end part of the correcting unit 70. The front flange portion 704 is composed of two wall portions spaced apart in the front-back direction. Specifically, the front flange portion 704 includes a first front flange 704A and a second front flange 704B. The first front flange 704A is the wall portion arranged on an axially outer side of the front flange portion 704. The second front flange 704B is the wall portion arranged on an axially inner side of the front flange portion 704. The first and second front flanges 704A, 704B are connected by a plurality of coupling bars (not shown) arranged at intervals in the circumferential direction.

The first guide portion 711 is a pair of plate-like members extending between the second rear flange 703B and the second front flange 704B (FIG. 6). Specifically, the first guide portion 711 includes an 11th guide 711A and a 12th guide 711B. The first guide portion 711 has a function of guiding a sheet being conveying in the horizontal conveyance path 50D to the nip portion N. Further, the first guide portion 711 has a function of guiding a sheet carried out from the nip portion N toward the outside of the conveying unit 70. The first guide portion 711 extends from the outer peripheral portion 70A (FIG. 4) of the correcting unit 70 toward the center of rotation CT of the correcting unit 70. As shown in FIG. 6, an 11th conveyance path 7A in which a sheet is conveyed is formed between the 11th and 12th guides 711A, 711B.

The second guide portion 712 is arranged at a side opposite to the first guide portion 711 across the center of rotation CT of the correcting unit 70. The second guide portion 712 is a pair of plate-like members extending between the second rear flange 703B and the second front flange 704B. Specifically, the second guide portion 712 includes a 21st guide 712A and a 22nd guide 712B. As shown in FIG. 6, the aforementioned hard roller 702 is arranged along the 21st guide 712A. Further, the aforementioned elastic rollers 701 are arranged along the 22nd guide 712B. In other words, the second guide portion 712 extends from the outer peripheral portion 70A of the correcting unit 70 toward the center of rotation CT of the correcting unit 70 across the nip portion N. As shown in FIG. 6, a 12th conveyance path 7B in which a sheet is conveyed is formed between the 21st and 22nd guides 712A, 712B. Note that the second guide portion 712 is not shown in FIG. 4.

The third guide portion 713 is a pair of plate-like members extending between the second rear flange 703B and the second front flange 704B. As shown in FIG. 6, the third guide portion 713 is arranged perpendicularly to the first and second guide portions 711, 712 between the first and second guide portions 711, 712. In other words, the third guide portion 713 is arranged at an interval of 90° from the first and second guide portions 711, 712 in the circumferential direction of the correcting unit 70. The third guide portion 713 includes a 31st guide 713A and a 32nd guide 713B. The third guide portion 713 extends from the outer peripheral portion 70A of the correcting unit 70 toward the center of rotation CT of the correcting unit 70. As shown in FIG. 7, a 21st conveyance path 7C in which a sheet is conveyed is formed between the 31st and 32nd guides 713A, 713B.

The fourth guide portion 714 is a pair of plate-like members extending between the second rear flange 703B and the second front flange 704B. As shown in FIG. 6, the fourth guide portion 714 is also arranged perpendicularly to the first and second guide portions 711, 712 between the first and second guide portions 711, 712. In other words, the fourth guide portion 714 is arranged at an interval of 90° from the first and second guide portions 711, 712 in the circumferential direction of the correcting unit 70. Further, the fourth guide portion 714 is arranged at a side opposite to the third guide portion 713 in a radial direction of the correcting unit 70. The fourth guide portion 714 includes a 41st guide 714A and a 42nd guide 714B. The fourth guide portion 714 extends from the outer peripheral portion 70A of the correcting unit 70 toward the center of rotation CT of the correcting unit 70 across the nip portion N. As shown in FIG. 7, a 22nd conveyance path 7D in which a sheet is conveyed is formed between the 41st and 42nd guides 714A, 714B.

The 11th and 12th conveyance paths 7A, 7B communicate with each other in the radial direction of the correcting unit 70 across the center of rotation CT of the correcting unit 70. Further, the 21st and 22nd conveyance paths 7C, 7D also communicate with each other in the radial direction of the correcting unit 70 across the center of rotation CT of the correcting unit 70.

Further, the correcting unit 70 includes an input gear 707, an intermediate gear 708 and a transmission gear 709 (FIG. 4).

The input gear 707 is a gear arranged on the unit shaft 700 axially outward of the first rear flange 703A. The input gear 707 is rotatable relative to the unit shaft 700. The input gear 707 is coupled to a drive motor 722 to be described later via an unillustrated gear.

The intermediate gear 708 is a gear portion arranged to correspond to the aforementioned cut-off part of the first rear flange 703A. The intermediate gear 708 is rotatably supported on the second rear flange 703B. The intermediate gear 708 includes a first intermediate gear portion 708A and a second intermediate gear portion 708B. The first and second intermediate gear portions 708A, 708B are gear parts adjacently arranged in the axial direction. The first intermediate gear portion 708A is engaged with the input gear 707. The second intermediate gear portion 708B is engaged with the transmission gear 709 to be described alter. The intermediate gear 708 receives a rotational drive force from the input gear 707 and transmits the rotational drive force to the transmission gear 709.

The transmission gear 709 is a gear rotatably supported between the first and second rear flanges 703A, 703B. The transmission gear 709 rotates the hard roller shaft 702A via an unillustrated gear member. When a rotational drive force is transmitted from the intermediate gear 708 to the transmission gear 709, the hard roller 702 is rotated via the gear member. With the rotation of the hard roller 702, the elastic rollers 701 are rotated, following the rotation of the hard roller 702.

The curl correcting device 7 further includes the rotary motor 721 (drive unit) and the drive motor 722.

The rotary motor 721 (FIG. 4) is arranged behind the correcting unit 70. The rotary motor 721 is a motor for generating a rotational drive force for rotating the correcting unit 70 about the unit shafts 700. The rotary motor 721 is coupled to the outer peripheral gear portion 703G of the rear flange portion 703 via an unillustrated transmission gear portion.

The drive motor 722 is arranged behind the correcting unit 70. The drive motor 722 is a motor for generating a rotational drive force for rotating the hard roller 702 in the correcting unit 70 about the hard roller shaft 702A. The drive motor 722 is engaged with the input gear 707 of the correcting unit 70, whereby the rotational drive force of the drive motor 722 is transmitted to the input gear 707. The rotational drive force is transmitted from the input gear 707 to the hard roller shaft 702A via the intermediate gear 708, the transmission gear 709 and the gear member. As a result, the hard roller 702 is rotated by the rotational drive force of the drive motor 722. Note that the input gear 707 is arranged on the same axis as the unit shafts 700 of the correcting unit 70. Thus, even if the correcting unit 70 rotates, an engaged position of the input gear 707 and the drive motor 722 does not change and the rotational drive force is stably input to the input gear 707.

With reference to FIG. 6, the curl correcting device 7 further includes the lower housing 73 (casing) and the upper housing 74 (casing). The lower and upper housings 73, 74 are housing members for housing the correcting unit 70. The lower and upper housings 73, 74 function as a casing for rotatably supporting the correcting unit 70. Further, as shown in FIG. 3, the lower and upper housings 73, 74 respectively define a right part of the conveying unit 55 (upstream part in the sheet conveying direction).

The lower housing 73 is arranged below the correcting unit 70. The lower housing 73 includes a lower carry-in portion 731, a lower supporting portion 732 and a lower carry-out portion 733.

The lower carry-in portion 731 is arranged below the horizontal conveyance path 50D and upstream of the correcting unit 70 in the sheet conveying direction and guides the sheet P toward the correcting unit 70. The lower supporting portion 732 is arranged downstream of the lower carry-in portion 731 in the sheet conveying direction and below the correcting unit 70. The lower supporting portion 732 defines a lower part of a space in which the correcting unit 70 rotates. The lower carry-out portion 733 is arranged downstream of the lower supporting portion 732 and the correcting unit 70 in the sheet conveying direction. The lower carry-out portion 733 guides the sheet P carried out from the nip portion N of the correcting unit 70 toward the downstream roller pair 55R.

The upper housing 74 is arranged above the correcting unit 70. The upper housing 74 includes an upper carry-in portion 741, an upper supporting portion 742 and an upper carry-out portion 743.

The upper carry-in portion 741 is arranged above the horizontal conveyance path 50D and upstream of the correcting unit 70 in the sheet conveying direction and guides the sheet P toward the correcting unit 70. The upper supporting portion 742 is arranged downstream of the upper carry-in portion 741 in the sheet conveying direction and above the correcting unit 70. The upper supporting portion 742 defines an upper part of the space in which the correcting unit 70 rotates. The upper carry-out portion 743 is arranged downstream of the upper supporting portion 742 and the correcting unit 70 in the sheet conveying direction. The upper carry-out portion 743 guides the sheet P carried out from the nip portion N of the correcting unit 70 toward the downstream roller pair 55R.

Next, a curl correcting operation of the curl correcting device 7 according to this embodiment is described. The control unit 800 is for totally controlling the curl correcting device 7 and electrically connected to a detection sensor 76 and a curl amount detection sensor 77 (detector) in addition to the aforementioned rotary motor 721 and the drive motor 722 as transmission and reception destinations of control signals.

The detection sensor 76 (FIG. 4) is arranged behind the correcting unit 70. The detection sensor 76 is a sensor for detecting an unillustrated detection piece arranged in the correcting unit 70. The detection sensor 76 includes unillustrated light emitter and light receiver. Detection light is emitted from the light emitter toward the light receiver. The detection piece is detected by the detection sensor 76 by the detection light being blocked by the detection piece. Every time the correcting unit 70 is rotated one turn, the detection piece is detected by the detection sensor 76 in correspondence with a predetermined position on the circumference of the correcting unit 70. Based on this detection timing, a counter 820 to be described later counts a step signal of the rotary motor 721. Then, based on the count, a drive controller 810 to be described later adjusts an angle of rotation of the rotary motor 721. As a result, an angle of rotation (rotational position) of the correcting unit 70 is controlled.

With reference to FIG. 2, the curl amount detection sensor 77 is arranged downstream of the fixing unit 60 and upstream of the correcting unit 70 in the sheet conveying direction. The curl amount detection sensor 77 detects a characteristic value corresponding to a curled amount of a sheet. In this embodiment, the curl amount detection sensor 77 is a distance measuring sensor arranged in the apparatus main body 10. The curl amount detection sensor 77 is arranged perpendicularly to a sheet surface of a sheet being conveyed. The curl amount detection sensor 77 is composed of a combination of unillustrated light emitting element and light receiving element based on a triangulation method. A semiconductor laser is used as the light emitting element. Light of the semiconductor laser is condensed through an unillustrated projection lens and irradiated to the sheet P. A part of a beam diffused and reflected by the sheet P forms a spot on the light receiving element through an unillustrated light receiving lens. As a result, a distance from the curl amount detection sensor 77 to an object is detected. The curl amount detection sensor 77 measures a distance to the sheet surface (position of the sheet surface) on a leading end part, a middle part and trailing end part of the sheet in the conveying direction. By fixing the mounted position of the curl amount detection sensor 77 in advance, the curl amount and curl direction of the sheet are detected from the plurality of distances.

The control unit 800 is composed of a CPU (Central Processing unit), a ROM (Read Only Memory) storing a control program, a RAM (Random Access Memory) used as a work area of the CPU and the like, and operates to functionally include the drive controller 810 (drive controller), the counter 820 and a storage 830 by executing the control program.

The drive controller 810 controls the rotation of the correcting unit 70 and that of the hard roller 702 by controlling the rotary motor 721 and the drive motor 722. Specifically, the drive controller 810 moves the correcting unit 70 between a first position, a second position and a third position to be described later according to sheet information of a sheet being conveyed in the horizontal conveyance path 50D. Note that the sheet information of the sheet may be information detected by the curl amount detection sensor 77 or may be sheet information (specification including paper type, paper thickness, etc.) input from an unillustrated input unit of the image forming apparatus 1.

The counter 820 counts a pulse step signal for the rotation of the rotary motor 721 based on a detection timing of the detection piece by the detection sensor 76. Based on the count result of the counter 820, the drive controller 810 controls the rotation of the rotary motor 721. As a result, a rotational angle (rotational position) of the correcting unit 70 is controlled.

The storage 830 stores a table for the calculation of a curl amount of a sheet P according to the characteristic value (distance) detected by the curl amount detection sensor 77 in advance. The drive controller 810 derives the curl amount and curl direction of the sheet with reference to the table stored in the storage 830 based on the detection result of the curl amount detection sensor 77. The rotation of the correcting unit 70 and the rotational angle of the correcting unit 70 are determined based on the curl amount and curl direction.

Next, the curl correction of the sheet P is described with reference to FIGS. 6 to 8. After being formed on the sheet P in the image forming section 30, a toner image is fixed to the sheet P in the fixing unit 60. At this time, as described above, the sheet P is easily curled such that a first surface is on an inner peripheral side and a second surface is on an outer peripheral side. In other words, as shown in FIG. 6, the sheet P tends to be in a so-called downwardly curled state where the tip thereof is warped downwardly. When the sheet P discharged from the fixing unit 60 passes through a position facing the curl amount detection sensor 77, distances from the curl amount detection sensor 77 to the leading end part, the middle part and the trailing end part of the sheet P in the sheet conveying direction are measured by the curl amount detection sensor 77. Then, the drive controller 810 detects the curl amount of the sheet P based on the measurement result of the curl amount detection sensor 77 and the table stored in advance in the storage 830. Further, the curl amount detection sensor 77 detects whether the sheet P is curled downwardly or upwardly (curl direction) based on a magnitude relationship of a plurality of detected distances.

Specifically, the drive controller 810 judges that the sheet P (P1 in FIG. 6) is curled if the detection result of the curl amount detection sensor 77 is not smaller than a threshold value of the curl amount stored in advance in the storage 830. Further, the drive controller 810 controls the rotary motor 721 in advance to arrange the correcting unit 70 at the first position shown in FIG. 6 when judging from the detection result of the curl amount detection sensor 77 that the sheet P1 is curled downwardly.

When the correcting unit 70 is arranged at the first position, the aforementioned 11th and 12th conveyance paths 7A, 7B form a first conveyance path SP1. Specifically, the first conveyance path SP1 extends in the correcting unit 70 and communicates with the horizontal conveyance path 50D and forms a part of the horizontal conveyance path 50D by arranging the correcting unit 70 at the first position about the unit shafts 700. In this case, the sheet P1 is conveyed through the nip portion N.

The sheet P1 is conveyed into the correcting unit 70 through a clearance between the lower carry-in portion 731 of the lower housing 73 and the upper carry-in portion 741 of the upper housing 74 (direction of an arrow DP of FIG. 6). The sheet P1 is carried into the nip portion N while passing through the 11th and 12th conveyance paths 7A, 7B of the first conveyance path SP1. At the first position of the correcting unit 70, the elastic rollers 701 are arranged on a lower side and the hard roller 702 is arranged on an upper side. As a result, the elastic rollers 701 come into contact with a first surface P1(1) of the sheet P1 and the hard roller 702 comes into contact with a second surface P1(2) of the sheet P1. Thus, the sheet P1 passes through the nip portion N curved to project downward along the peripheral surface of the hard roller 702, whereby the downward curl of the sheet P1 is properly corrected.

The sheet P1 having passed through the nip portion N is carried out from the correcting unit 70 while passing through a clearance between the 21st and 22nd guides 712A, 712B. Then, the sheet P1 is conveyed toward the downstream roller pair 55R while further passing through a clearance between the lower and upper carry-out portions 733, 743.

On the other hand, depending on the paper quality of the sheet P being conveyed in the horizontal conveyance path 50D, the sheet P carried out from the fixing unit 60 may be not curled. The drive controller 810 judges that the sheet P (P2 in FIG. 7) is not curled if the detection result of the curl amount detection sensor 77 is smaller than the threshold value of the curl amount stored in advance in the storage 830. In this case, the drive controller 810 controls the rotary motor 721 in advance to arrange the correcting unit 70 at the second position shown in FIG. 7. Note that if the correcting unit 70 is arranged at the first position in an immediately previous state, it is rotated clockwise by 90° from the state of FIG. 6.

When the correcting unit 70 is arranged at the second position, the aforementioned 21st and 22nd conveyance paths 7C, 7D form a second conveyance path SP2. Specifically, the second conveyance path SP2 extends in the correcting unit 70 and communicates with the horizontal conveyance path 50D and forms a part of the horizontal conveyance path 50D by arranging the correcting unit 70 at the second position about the unit shafts 700. In this case, the sheet P2 is conveyed while passing through an area different from the nip portion N without passing through the nip portion N.

The sheet P2 is conveyed into the correcting unit 70 through the clearance between the lower carry-in portion 731 of the lower housing 73 and the upper carry-in portion 741 of the upper housing 74 (direction of an arrow DP of FIG. 7). The sheet P2 is carried out from the correcting unit 70 while passing through the 21st and 22nd conveyance paths 7C, 7D of the second conveyance path SP2. Then, the sheet P2 is conveyed toward the downstream roller pair 55R while further passing through the clearance between the lower and upper carry-out portions 733, 743. As just described, the sheet P2 does not pass through the nip portion N if the correcting unit 70 is arranged at the second position. This inhibits the sheet P2, which is not curled, from being curled in the nip portion N.

Further, depending on the paper quality of the sheet P, the sheet P carried out from the fixing unit 60 may be curled upwardly. In this case, the sheet is so curled that the first surface is on the outer peripheral side and the second surface is on the inner peripheral side. In other words, as shown in FIG. 8, the leading end of the sheet P (P3) is warped upwardly. If the sheet P3 is curled upwardly in this way, the drive controller 810 controls the rotary motor 721 in advance to arrange the correcting unit 70 at the third position shown in FIG. 8. Note that if the correcting unit 70 is arranged at the second position in an immediately previous state, it is rotated clockwise by 90° from the state of FIG. 7.

When the correcting unit 70 is arranged at the third position, the aforementioned 11th and 12th conveyance paths 7A, 7B form a third conveyance path SP3. Specifically, the third conveyance path SP3 extends in the correcting unit 70 and communicates with the horizontal conveyance path 50D and forms a part of the horizontal conveyance path 50D by arranging the correcting unit 70 at the third position about the unit shafts 700. In this case, the nip portion N is formed in a state where the arrangement of the elastic rollers 701 and the hard roller 702 is switched from that in the first conveyance path SP1. Then, the sheet P3 enters the nip portion N from a side (outer peripheral side of the correcting unit 70) opposite to the sheet P1 conveyed in the first conveyance path SP1.

The sheet P3 is conveyed into the correcting unit 70 through the clearance between the lower carry-in portion 731 of the lower housing 73 and the upper carry-in portion 741 of the upper housing 74 (direction of an arrow DP of FIG. 8). The sheet P3 is carried into the nip portion N while entering the 12th conveyance path 7B of the third conveyance path SP3. At the third position of the correcting unit 70, the elastic rollers 701 are arranged on the upper side and the hard roller 702 is arranged on the lower side. As a result, the elastic rollers 701 come into contact with a second surface P3(2) of the sheet P3 and the hard roller 702 comes into contact with a first surface P3(1) of the sheet P3. Thus, the sheet P3 passes through the nip portion N curved to project upward along the peripheral surface of the hard roller 702, whereby the upward curl of the sheet P3 is properly corrected.

The sheet P3 having passed through the nip portion N is carried out from the correcting unit 70 while passing through a clearance between the 11th and 12th guides 711A, 711B. Then, the sheet P3 is conveyed toward the downstream roller pair 55R while further passing through the clearance between the lower and upper carry-out portions 733, 743.

As described above, if the sheet P being conveyed in the horizontal conveyance path 55D is curled, it can be carried into the nip portion N by arranging the correcting unit 70 at the first or third position. In this case, the curl is properly corrected in the curved nip portion N formed between the elastic rollers 701 and the hard roller 702. On the other hand, if the sheet P being conveyed in the horizontal conveyance path 55D is not curled, it is conveyed without passing through the nip portion N by arranging the correcting unit 70 at the second position. Thus, regardless of whether or not the sheet P being conveyed in the horizontal conveyance path 50D is curled, the sheet P can be carried out in a curl-free state. In other words, the sheet P, which is not curled, is inhibited from being carried into the nip portion N, thereby preventing the sheet P from being erroneously curled. As a result, regardless of whether or not the sheet P being conveyed in the horizontal conveyance path 50D is curled, the sheet P can be carried out in the curl-free state.

Particularly, the position of the correcting unit 70 is set according to the sheet information of the sheet P being conveyed in the horizontal conveyance path 50D, specifically, the curled state of the sheet P detected by the curl amount detection sensor 77. Thus, the arrangement of the correcting unit 70 can be accurately switched according to an actual state of the sheet P being conveyed in the horizontal conveyance path 50D. Further, even if the sheet P is curled in a different direction, the curl can be corrected by arranging the correcting unit 70 at the first or third position.

Further, in a cross-section intersecting with the unit shafts 700, the first and second conveyance paths SP1, SP2 intersect with each other with the center of rotation CT as an intersection. Thus, the first and second conveyance paths SP1, SP2 extend to pass through the center of rotation CT. As a result, the switch of the conveyance path is realized by the rotation of the correcting unit 70 when the sheet P is conveyed along the first or second conveyance path SP1 or SP2. At this time, since the positions of the entrances and exits of the first and second conveyance paths SP1, SP2 of the correcting unit 70 overlap, it is possible to commonly use the conveyance paths upstream of and downstream of the correcting unit 70. In other words, it is not necessary to widen the conveyance paths upstream of and downstream of the correcting unit 70 or to provide a plurality of conveyance paths at each of the upstream and downstream sides of the correcting unit 70. Further, since the first and second conveyance paths SP1, SP2 are perpendicularly arranged in the cross-section intersecting with the unit shafts 700, the first and second conveyance paths SP1, SP2 can be switched by rotating the correcting unit 70 by 90° about the unit shafts 700.

Further, in the above embodiment, the curl correcting device 7 can be arranged utilizing the conveying unit 55. Further, the curl of the sheet P is stably corrected before the sheet P reaches the post-processing apparatus.

Although the curl correcting device 7 and the image forming apparatus 1 with the same according to the embodiment of the present disclosure have been described above, the present disclosure is not limited to this. For example, the following modifications can be adopted.

Figure 9:
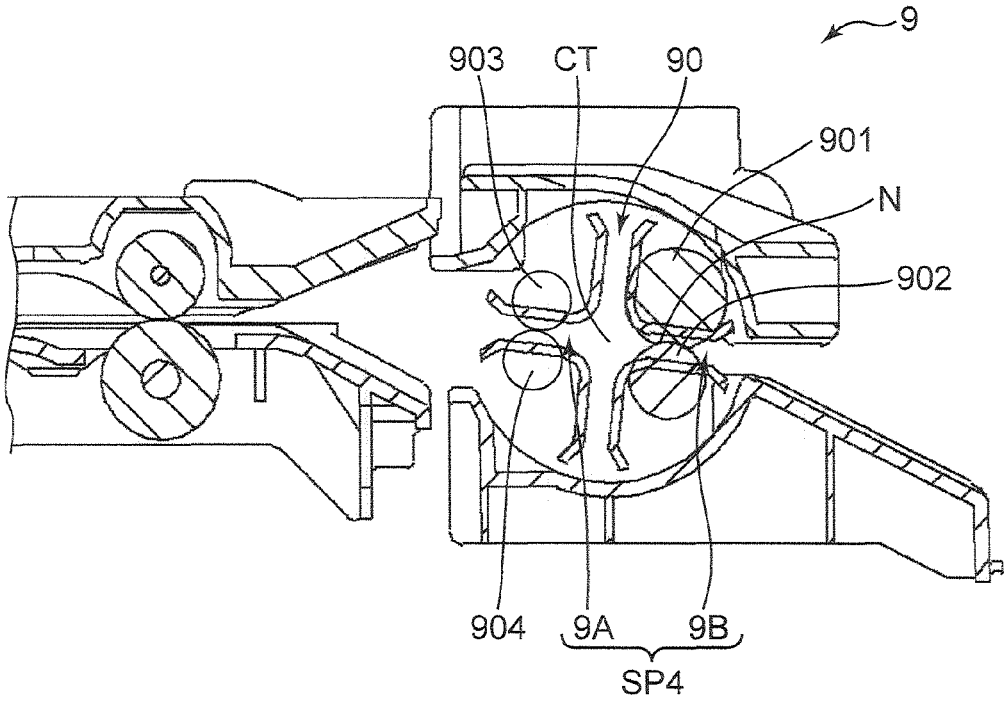
FIG. 9 is a sectional view of a curl correcting device according to another embodiment of the present disclosure.

(1) In the above embodiment, the nip portion N is arranged at one end side (12th conveyance path 7B) of the first conveyance path SP1 with respect to the center of rotation CT and the other end side (11th conveyance path 7A) of the first conveyance path SP1 with respect to the center of rotation CT is composed only of the conveyance path in the cross-section intersecting with the unit shafts 700. The present disclosure is not limited to this. FIG. 9 is a sectional view of a curl correcting device 9 according to a modification of the present disclosure. The curl correcting device 9 includes a correcting unit 90. The correcting unit 90 can also be arranged at the first, second and third positions about an unillustrated axis of rotation similarly to the previous correcting unit 70.

The correcting unit 90 is characterized by including inner conveyor rollers 903, 904 (conveyor roller) in an 11th conveyance path 9A corresponding to the 11th conveyance path 7A of the previous embodiment inside. Specifically, a nip portion N is formed by elastic rollers 901 and a hard roller 902 arranged at one end side (one of the upstream side and the downstream side) of a first conveyance path SP4 of the correcting unit 90 with respect to a center of rotation CT. Further, the inner conveyor rollers 903, 904 are arranged at the other end side (the other of the upstream side and the downstream side) of the first conveyance path SP4 of the correcting unit 90 opposite to the nip portion N with respect to the center of rotation CT and convey a sheet P. In this case, the sheet P can be stably conveyed toward the nip portion N in the correcting unit 90. Further, the sheet P carried out from the nip portion N can be stably conveyed toward the outside of the correcting unit 90.

(2) Although the curl amount detection sensor 77, which is a distance measuring sensor, is used as the sensor for detecting the characteristic value corresponding to the curl amount of the sheet P in the above embodiment, the present disclosure is not limited to this. Another sensor may be used as the sensor for detecting the characteristic value corresponding to the curl amount. For example, a light reflection type sensor may be used to detect the curl amount of the sheet P from an angle of reflection of light irradiated toward the leading end part of the sheet P.

(3) Although the correcting units 70 and 90 can be arranged at the first, second and third positions in the above embodiment and modification, the present disclosure is not limited to this. In another modification, a correcting unit may be switched between the first and second positions. Further, a rotating direction associated with a position change of the correcting unit may be appropriately selected from a clockwise direction and a counterclockwise direction in consideration of a switching time.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A curl correcting device connected to an apparatus main body which includes a sheet conveyance path through which a sheet is conveyed, comprising:

an first roller with elastically deformable property including a first rotary shaft and configured to rotate about the first rotary shaft;

a second roller including a second rotary shaft parallel to the first rotary shaft and configured to rotate about the second rotary shaft and elastically deform the first roller by being pressed against the first roller, thereby forming a curved nip portion between the first and second rollers; and a supporting unit including a third rotary shaft parallel to the first rotary shaft and configured to rotatably support the first and second rollers by rotatably supporting the first and second rotary shafts and supported in the apparatus main body rotatably about the third rotary shaft; wherein the supporting unit includes a plurality of inner conveyance paths inside configured to be a part of the sheet conveyance path, the plurality of inner conveyance paths includes a first conveyance path which has the nip portion and a second conveyance path which does not have the nip portion, the second conveyance path intersects with the first conveyance path, the first conveyance path communicates with the sheet conveyance path by the supporting unit being arranged at a first position about the third rotary shaft; and the second conveyance path communicates with the sheet conveyance path by the supporting unit being arranged at a second position about the third rotary shaft, wherein the first and second conveyance paths intersect with each other with a center of rotation of the supporting unit as an intersection.

2. An image forming apparatus, comprising:

a curl correcting device according to claim 1;

an apparatus main body; and an image forming section configured to form an image on a sheet.

3. A curl correcting device according to claim 1, wherein:

the first and second conveyance paths are perpendicularly arranged.

4. An image forming apparatus, comprising:

a curl correcting device according to claim 3;

an apparatus main body; and an image forming section configured to form an image on a sheet.

5. A curl correcting device according to claim 1, wherein:

the inner conveyance path includes a third conveyance path which has the nip portion, the third conveyance path communicates with the sheet conveyance path by arranging the supporting unit at a third position about the third rotary shaft, the nip portion in the third conveyance path is formed in a state where the arrangement of the first and second rollers is switched from that in the first conveyance path.

6. An image forming apparatus, comprising:

a curl correcting device according to claim 5;

an apparatus main body; and an image forming section configured to form an image on a sheet.

7. An image forming apparatus according to claim 6, further comprising:

a drive unit configured to rotate the supporting unit about the third rotary shaft; and a drive controller configured to control the drive unit;

wherein the drive controller moves the supporting unit between the first, second and third positions according to sheet specification of the sheet being conveyed in the sheet conveyance path.

8. An image forming apparatus according to claim 6, further comprising:

a drive unit configured to rotate the supporting unit about the third rotary shaft;

a drive controller configured to control the drive unit; and a detector arranged upstream of the supporting unit in the conveying direction and configured to detect a curl amount of the sheet;

wherein the drive controller arranges the supporting unit at the first or third position if the curl amount of the sheet detected by the detector is not smaller than a threshold value set in advance while arranging the supporting unit at the second position if the curl amount of the sheet is smaller than the threshold value.

9. An image forming apparatus according to claim 8, wherein:

the detector further detects a curl direction of the sheet;

the drive controller arranges the supporting unit at the first or third position based on the curl direction of the sheet detected by the detector.

10. An image forming apparatus according to claim 9, wherein:

a first surface of the sheet comes into contact with the first roller and a second surface of the sheet opposite to the first surface comes into contact with the second roller at the first position of the supporting unit; and the drive controller arranges the supporting unit at the first position if it is detected by the detector that the sheet is curled in such a direction that the first surface of the sheet is on an inner peripheral side and the second surface is on an outer peripheral side while arranging the supporting unit at the third position if it is detected by the detector that the sheet is curled in such a direction that the second surface of the sheet is on the inner peripheral side and the first surface is on the outer peripheral side.

11. An image forming apparatus, comprising:

a curl correcting device according to claim 1;

an apparatus main body; and an image forming section configured to form an image on a sheet.

12. An image forming apparatus according to claim 11, further comprising:

a drive unit configured to rotate the supporting unit about the third rotary shaft; and a drive controller configured to control the drive unit;

wherein the drive controller moves the supporting unit between the first and second positions according to a sheet specification of the sheet being conveyed in the sheet conveyance path.

13. An image forming apparatus according to claim 11, further comprising:

a drive unit configured to rotate the supporting unit about the third rotary shaft;

a drive controller configured to control the drive unit; and a detector arranged upstream of the supporting unit in the conveying direction and configured to detect a curl amount of the sheet;

wherein the drive controller arranges the supporting unit at the first position if the curl amount of the sheet detected by the detector is not smaller than a threshold value set in advance while arranging the supporting unit at the second position if the curl amount of the sheet is smaller than the threshold value.

14. A curl correcting device connected to an apparatus main body which includes a sheet conveyance path through which a sheet is conveyed, comprising:

an first roller with elastically deformable property including a first rotary shaft and configured to rotate about the first rotary shaft;

a second roller including a second rotary shaft parallel to the first rotary shaft and configured to rotate about the second rotary shaft and elastically deform the first roller by being pressed against the first roller, thereby forming a curved nip portion between the first and second rollers; and a supporting unit including a third rotary shaft parallel to the first rotary shaft and configured to rotatably support the first and second rollers by rotatably supporting the first and second rotary shafts and supported in the apparatus main body rotatably about the third rotary shaft; wherein the supporting unit includes a plurality of inner conveyance paths inside configured to be a part of the sheet conveyance path, the plurality of inner conveyance paths includes a first conveyance path which has the nip portion and a second conveyance path which does not have the nip portion, the second conveyance path intersects with the first conveyance path, the first conveyance path communicates with the sheet conveyance path by the supporting unit being arranged at a first position about the third rotary shaft; and the second conveyance path communicates with the sheet conveyance path by the supporting unit being arranged at a second position about the third rotary shaft, the nip portion is arranged at one of the upstream side and the downstream side of the first conveyance path with respect to a center of rotation of the supporting unit; and the curl correcting device further comprises a conveyor roller arranged at the other of the upstream side and the downstream side of the first conveyance path with respect to the center of rotation and configured to convey the sheet.

15. An image forming apparatus, comprising:

a curl correcting device according to claim 14;

an apparatus main body; and an image forming section configured to form an image on a sheet.

* * * * *